US007579540B2

(12) United States Patent
Takegawa

(10) Patent No.: US 7,579,540 B2
(45) Date of Patent: Aug. 25, 2009

(54) BEATER HOLDER WITH ADJUSTMENT FEATURE

(75) Inventor: Akito Takegawa, Chiba (JP)

(73) Assignee: Pearl Musical Instrument Co., Chiba (JP)

( * ) Notice: Subject to any disclaimer, the term of this patent is extended or adjusted under 35 U.S.C. 154(b) by 0 days.

(21) Appl. No.: 12/125,261

(22) Filed: May 22, 2008

(65) Prior Publication Data

US 2009/0178539 A1 Jul. 16, 2009

Related U.S. Application Data

(60) Provisional application No. 61/006,502, filed on Jan. 16, 2008.

(51) Int. Cl.
*G10D 13/02* (2006.01)

(52) U.S. Cl. ..... 84/422.1

(58) Field of Classification Search ..... 84/422.1, 84/422.2, 422.3, 421
See application file for complete search history.

(56) References Cited

U.S. PATENT DOCUMENTS

| | | | | |
|---|---|---|---|---|
| 2,484,302 | A | 10/1949 | Laverents | |
| 4,691,612 | A | 9/1987 | Smith | |
| 5,297,467 | A | 3/1994 | Hoshino | |
| 5,343,792 | A | 9/1994 | Liao | |
| 5,379,674 | A | 1/1995 | Hoshino | |
| 5,388,494 | A | 2/1995 | Hoshino | |
| 5,659,144 | A | 8/1997 | Shigenaga | |
| 5,895,168 | A | 4/1999 | Liao | |
| 5,998,718 | A | 12/1999 | Liao | |
| 6,172,291 | B1 | 1/2001 | Takegawa | |
| 6,894,210 | B1 | 5/2005 | Lombardi | |
| 2006/0156900 | A1 | 7/2006 | Dorfman et al. | |
| 2006/0156901 | A1 | 7/2006 | Dorfman et al. | |
| 2007/0131088 | A1 * | 6/2007 | Hauck | 84/422.1 |
| 2008/0173159 | A1 * | 7/2008 | Chen | 84/422.1 |

* cited by examiner

*Primary Examiner*—Kimberly R Lockett
(74) *Attorney, Agent, or Firm*—Berenato, White & Stavish, LLC

(57) ABSTRACT

A beater holder apparatus for a bass drum pedal enables adjustment of the amplitude of swing of a drum beater with respect to a drum head, comprises a beater holder that is configured to for radial adjustment with respect to the beater shaft. The assembly comprises a support; a shaft supported by the support and rotatable around the axis of the shaft. A pedal is pivotable between an operating position to which the pedal is operated by the operator and a return position. A connecting system connects the pedal to the shaft such that movement of the pedal between the operating and return positions rotates the shaft and rotates the beater head toward and away from the drum head for beating the drum head. The beater holder can be angled infinitely and can be mounted to the pedal's axle to provide a "LIGHT" or "HEAVY" feel to provide a dual adjustment structure. Further, the invention has a clam-shell design for easy change-over to the "LIGHT" and "HEAVY" positions without dismantling the pedal.

17 Claims, 7 Drawing Sheets

BEATER HOLDER WITH ADJUSTMENT FEATURE

This application is a U.S. Utility Application based on U.S. Provisional Patent Application No. 61/006,502 filed Jan. 16, 2008 and is hereby incorporated by references in its entirety.

BACKGROUND OF THE INVENTION

1. Field of the Invention

The present invention relates to a foot pedal for a drum in which the drum head of a bass drum is struck when the foot pedal is depressed with the foot and more particularly to a drum foot pedal which is designed so that the position of the beater of the foot pedal can be freely changed to suit the player.

2. Description of Related Art

A bass drum is generally equipped with a beater driven by a pedal driven mechanism. The pedal driven mechanism comprises a shaft, a pedal, a swivel member fixedly connected to the shaft, a chain connected between the pedal and the swivel member, and return spring means for returning the shaft after each pedal stroke. When playing different music, the beater may have to be driven to give different beating force to the face of the bass drum. However, because the amplitude of the beater is not adjustable, it is difficult to control the beating force of the beater accurately.

FIG. 1 is a perspective view which shows a conventional example of such a foot pedal for a drum. This conventional foot pedal may be described briefly as follows: the drum foot pedal 1 is equipped with a pedal frame 2 which is to be placed on the floor surface. This pedal frame 2 is made up of a frame main body 2A, a pair of left and right supporting columns 2B which are installed in upright positions on the upper surface of the frame main body 2A, and a heel 2C which is connected to the frame main body 2A via a connecting member 3, etc. A clamping member 6 which holds the tightening frame (or hoop) 5 of a bass drum 4 is attached to the frame main body 2A. A rotatable shaft 7 is provided between the upper ends of the pair of supporting columns 2B, 2B via bearings so that the rotatable shaft 7 is free to rotate, and a rocker 8 is attached to the center of the rotatable shaft 7. Furthermore, a beater 10 which strikes the drum head 9 of the bass drum 4 is provided on the rocker 8 via a beater rod 11, and one end of a pedal depressing force transmission member 13 which transmits the depressing force of a foot board 12 to the beater 10 is connected to the rocker 8. A timing belt, a flexible leather or plastic band, a chain, a linkage, etc. may be used as the pedal depressing force transmission member 13. The foot board 12 is formed as a flat plate of sufficient size to accommodate the foot. The front end 12*a* of the foot board 12 is connected to the other end of the pedal depressing force transmission member 13, and the rear end 12*b* of the foot board 12 is connected to the heel 2C via a shaft 14 so that the foot board 12 can pivot upward and downward. Furthermore, the upper end of a return spring 15 which imparts a pivoting habit to the foot board 12 in the return direction is connected to one end of the rotatable shaft 7 via a cam plate 16, and the lower end of this return spring 15 is connected to a spring receiving member 17 which is provided at the lower end of one of the supporting columns 2B.

Furthermore, reference 18 indicates a hoop fastening screw which presses the clamping part 6 against the hoop 5.

In the drum foot pedal 1 constructed as described above, the foot board 12 is ordinarily maintained at a prescribed inclination with the front end lifted as shown in the Figure by the spring force of the return spring 15. When a depressing force is applied to the foot board 12 in this state, the pedal depressing force transmission member 13 is pulled downward, and the beater 10 pivots along with the rotatable shaft 7 and strikes the drum head 9 of the bass drum 4. The maximum angle of depression of the foot board 12 in this case is approximately 15°. When the depressing force is removed from the foot board 12 after the beater 10 has struck the drum head 9, the foot board 12 is caused to pivot upward by the spring force of the return spring 15, so that the foot board 12 returns to its initial position.

However, in the conventional drum foot pedal 1 as described above, the beater rod 11 is merely fastened to the rocker 8 which in turn is fastened to the rotatable shaft 7 in such a manner that the length of the beater rod 11 can be adjusted. Accordingly, the pivoting angle of the beater 10 and the striking position of the beater 10 on the drum head surface is not adjusted freely. In this case, it is possible to attach the rocker 8 to the rotatable shaft 7 so that the rocker 8 can pivot relative to the rotatable shaft 7 so that the pivoting angle of the beater 10 can be changed.

In light of these drawbacks, several prior art attempts have been made to provide a beater assembly where the beater holder may be angularly adjusted on the rotatable beater shaft 7. However, these prior art adjustment system are limited to a single angular adjustment which limits the amount the position of the beater of the foot pedal can be changed to suit the player.

SUMMARY OF THE INVENTION

A beater holder apparatus for a bass drum pedal enables adjustment of the amplitude of swing of a drum beater with respect to a drum head, comprises a beater holder that is configured for radial adjustment with respect to the beater shaft. The assembly comprises a support; a shaft supported by the support and rotatable around the axis of the shaft. A pedal is pivotable between an operating position to which the pedal is operated by the operator and a return position. A connecting system connects the pedal to the shaft such that movement of the pedal between the operating and return positions rotates the shaft and rotates the beater head toward and away from the drum head for beating the drum head. The beater holder can be angled infinitely and can be mounted to the pedal's axle to provide a "LIGHT" or "HEAVY" feel to provide a dual adjustment structure. Further, the invention has a clam-shell design for easy change-over to the "LIGHT" and "HEAVY" positions without dismantling the pedal.

These and other objects and advantages of the invention, as well as the details of an illustrative embodiment, will be more fully understood from the following specification and drawings, in which:

DETAILED DESCRIPTION OF THE PREFERRED EMBODIMENTS

Figure 1:
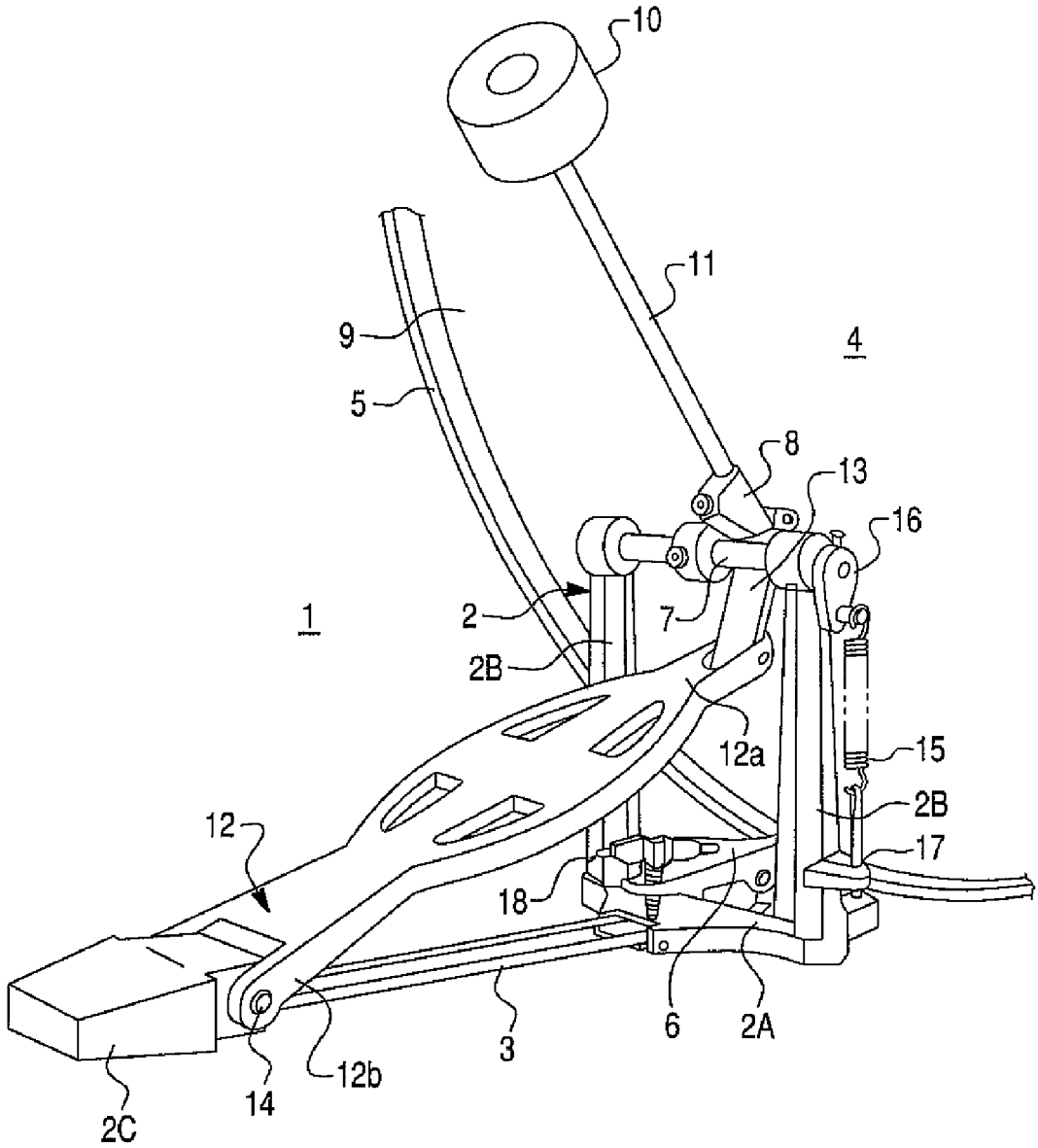
Fig. 1 Prior Art
FIG. 1 is a perspective view of a conventional foot pedal assembly mounted to a bass drum.
Figure 2:
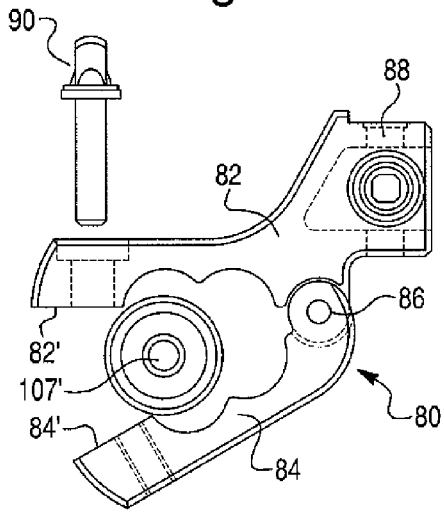
FIG. 2 is a plan view of the clam-shell beater holder according to this invention in an open position relative to the axle shaft.
Figure 3:
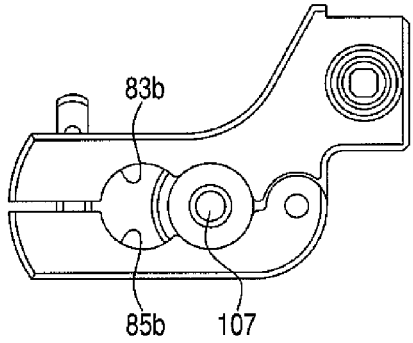
FIG. 3 is a plan view of the clam-shell beater holder of FIG. 2 shown affixed to an axle shaft in a heavy-feel position.
Figure 4:
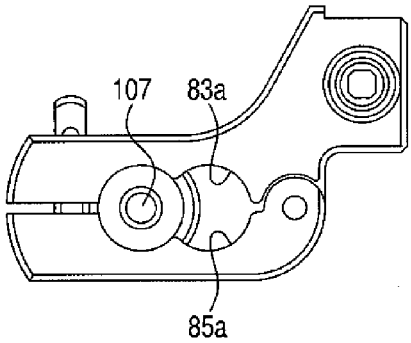
FIG. 4 is a plan view of the clam-shell beater holder of FIG. 2 shown affixed to an axle shaft in a light-feel position.

With reference to FIGS. 2-4, the beater holder 80 of the present invention is illustrated with FIG. 2 showing the functional features of the clam-shell aspect of the beater holder 80. Specifically, the beater holder 80 comprises a main body 82 and a hinged arm 84 that is hingedly connected to the main body 82 through hinge 86 thereby defining a clam-shell body that affixes the beater holder 80 to the rotatable shaft (shown as element 107' in FIG. 2) of the foot pedal assembly as will be described in more detail below.

As with a conventional beater holder, the main body 82 includes a mounting aperture 88 to mount the beater rod as will be described in greater detail below. As with the conventional beater holders, the beater rod 11 is fastened to the beater holder 80 and fixed by a set screw or other fastening device, and the beater holder 80 in turn is fastened to the rotatable shaft 107 in such a manner that the length of the beater rod can be adjusted.

A hex nut or other suitable fastener 90 selectively clamps the beater holder 80 to the rotatable shaft 107 via a threaded connection between the fastener 90 and the hinged arm 84.

In accordance with the present invention, the main body 82 and hinged arm 84 have opposing clamping faces 82', 84' that are formed with concave surfaces to provide multiple mounting positions for the beater holder 80 with respect to the rotatable shaft 107. Specifically, the main body 82 is provided with inner concave surface 83*a* and outer concave surface 83*b*, and the hinged arm 84 is provided with inner concave surface 85*a* and outer concave surface 85*b*. Depending on the particular feel a musician wants from the bass drum, the beater holder can be mounted at the two different positions defined by the inner concave surfaces 83*a*, 85*a* (see FIG. 3) or at the outer concave surfaces 83*b*, 85*b* (see FIG. 4).

Figure 5B:
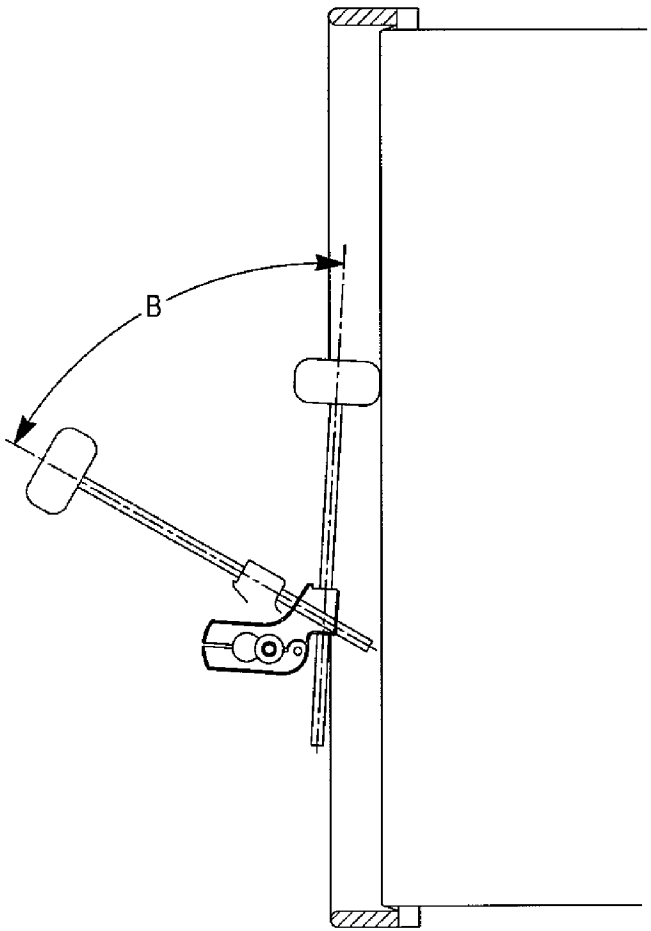
FIGS. 5*a* and 5*b* are schematic illustration of the different beater positions provided by the beater holder of the present invention.
Figure 5A:
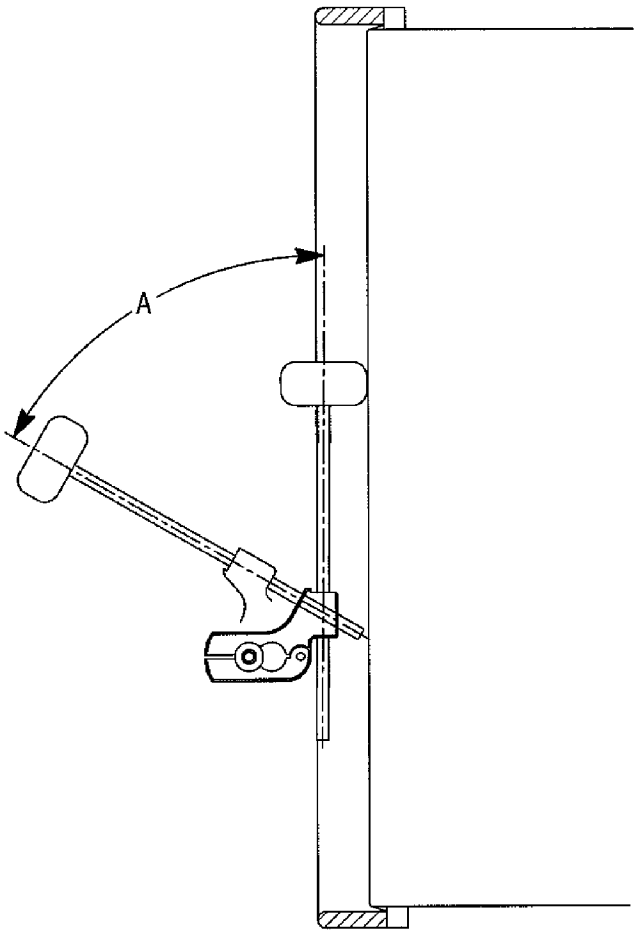

FIGS. 5*a* and 5*b* are schematic illustration of the different radial beater positions provided by the beater holder of the present invention. The angle of the beater relative to the head can be the same regardless of which hole is used (see FIG. 5*a* and 5*b*). It's the height of the beater holder and therefore the leverage that gives the "heavy" and "light" feel. The higher beater holder position gives more leverage and thus takes less force propel the beater. The lower beater holder position gives less leverage thus takes more force to propel the beater. When the beater holder takes closer radial position with respect to the axle shaft (see FIG. 3), the angle and height between the beater head and the drum skin (Angle B) are bigger than the far position (see FIG. 4) to the axle and height (Angle A). Therefore, in the closer position (FIG. 3), the player needs more power and the beater would provide a "heavy" feel. The beater would feel heavier to the user. With reference to FIGS. 5*a* and 5*b*, the angle A is smaller than the angle B.

Figure 6:
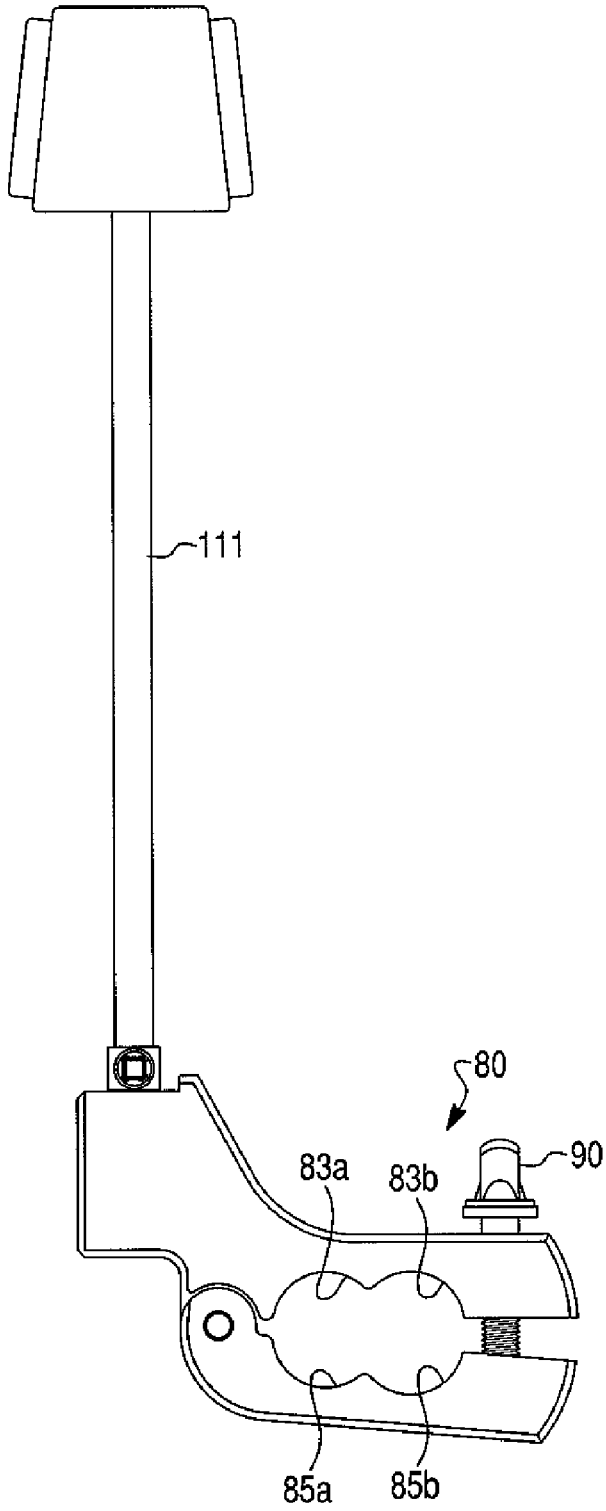
FIG. 6 is a plan view of the beater holder of FIG. 2 with a beater mounted thereto.

FIG. 6 is a plan view showing the beater holder 80 having a beater mounted to the beater holder via the beater rod 111 which is fastened to the beater holder through a suitable fastener known to those of skill in the art. Further, the beater may be configured to provide multiple beater head surfaces and material as described in U.S. Pat. No. 5,610,351 which is hereby incorporated by reference in its entirety.

Figure 7:
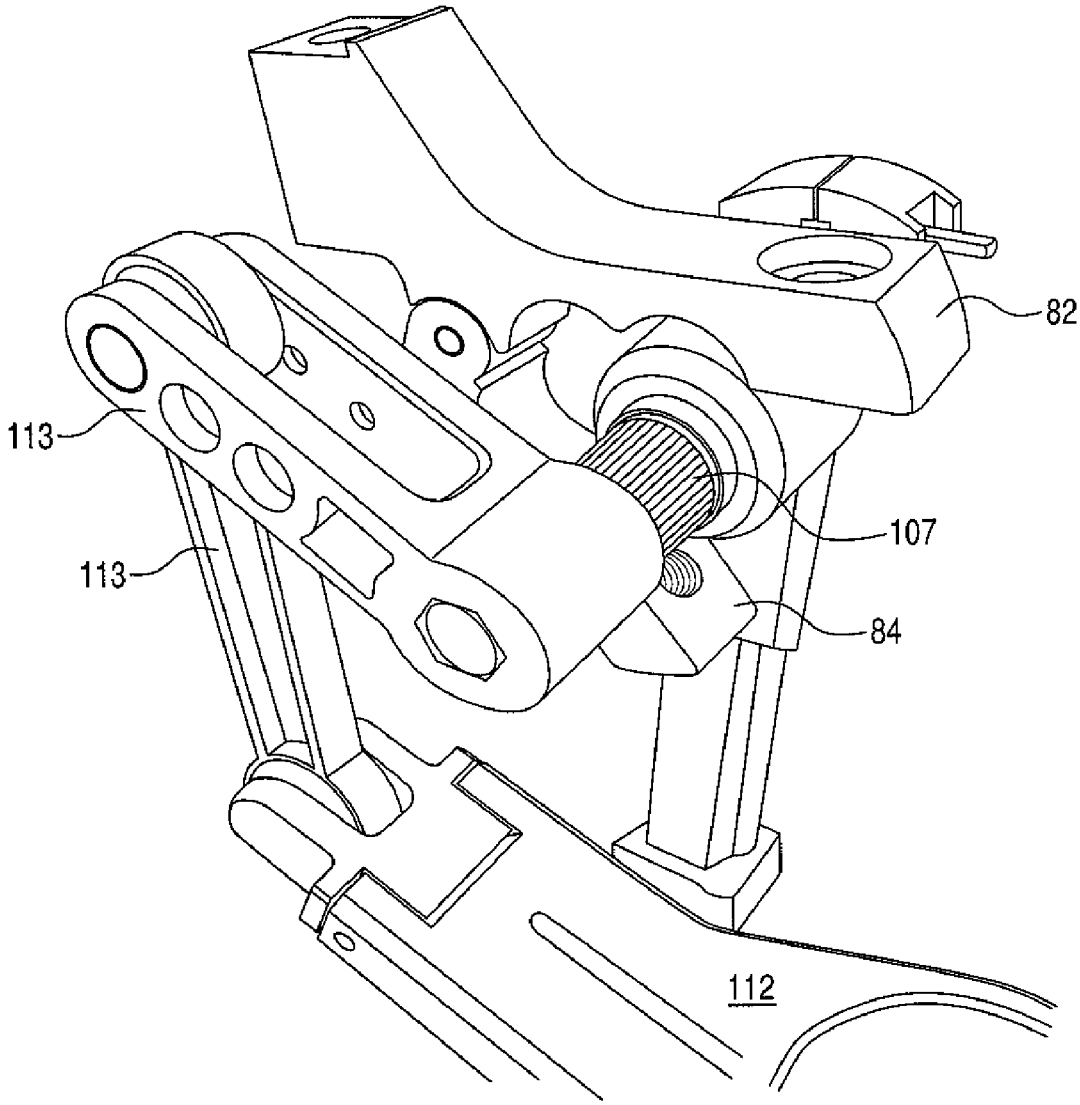
FIG. 7 is a perspective view showing the beater holder of the present invention being mounted onto the axle shaft with the fastener.

FIG. 7 is a perspective view showing the beater holder 80 of the present invention being mounted onto the axle shaft 107 with the fastener 90 (see FIG. 2 omitted). Due to the unique clam-shell design of the beater holder 80, the beater holder 80 may be disposed on the axle shaft 107 in one of two positions; the heavy position or the light position. The drum pedal shown in FIG. 7 utilizes a drive linkage 113 connecting the pedal 112 to the drive axle shaft 107; however, other types of pedal assemblies may employ the beater holder according to this invention without departing from the spirit and scope of this invention.

Figure 8:
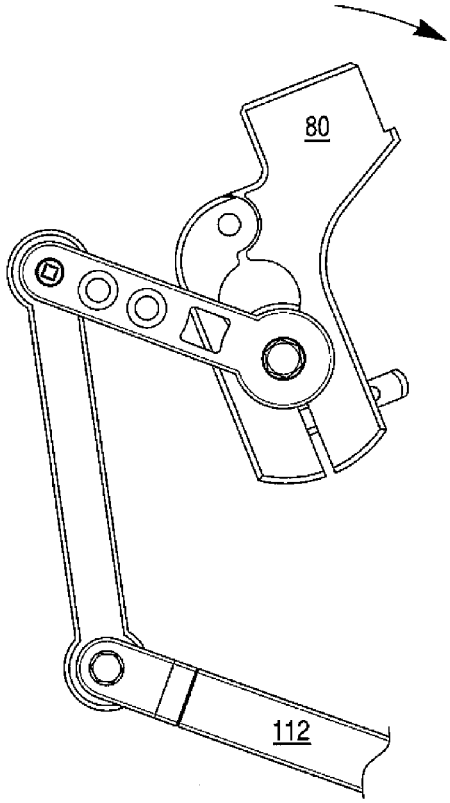
FIGS. 8 and 9 show the beater holder mounted in the "light" position on the shaft.
Figure 9:
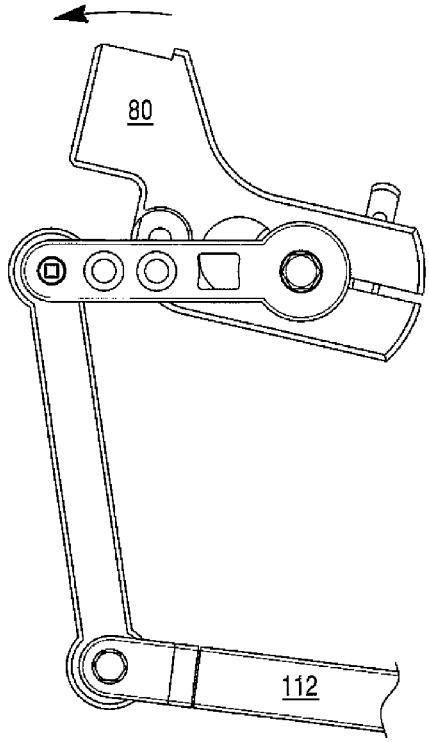

FIGS. 8 and 9 show the beater holder 80 mounted in the "light" position on the shaft 107 such that the beater (not shown) is positioned linearly or radially away from the drum surface that is struck by the beater. In the view shown in FIG. 8, the pedal assembly is shown with the beater angled away from the drum surface like the schematic shown in FIG. 5*a*. As the pedal is depressed, the axle shaft rotates and the beater approaches the drum surface as shown in FIG. 9.

Figure 10:
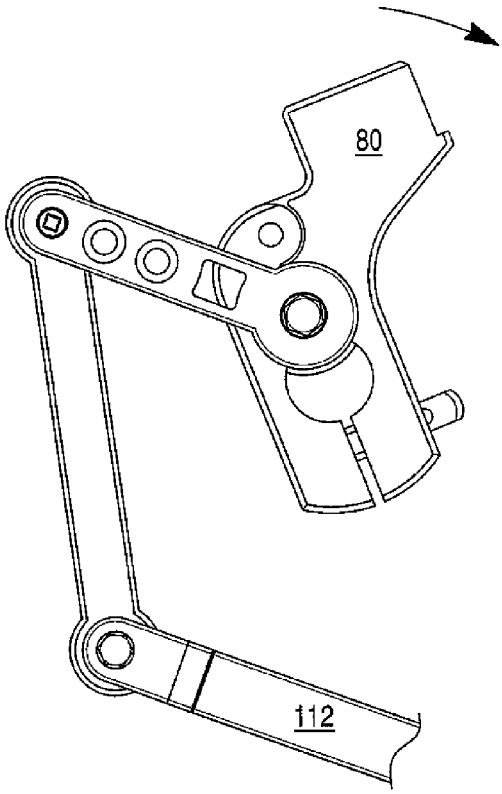
FIGS. 10 and 11 show the beater holder mounted in the "heavy" position on the shaft.
Figure 11:
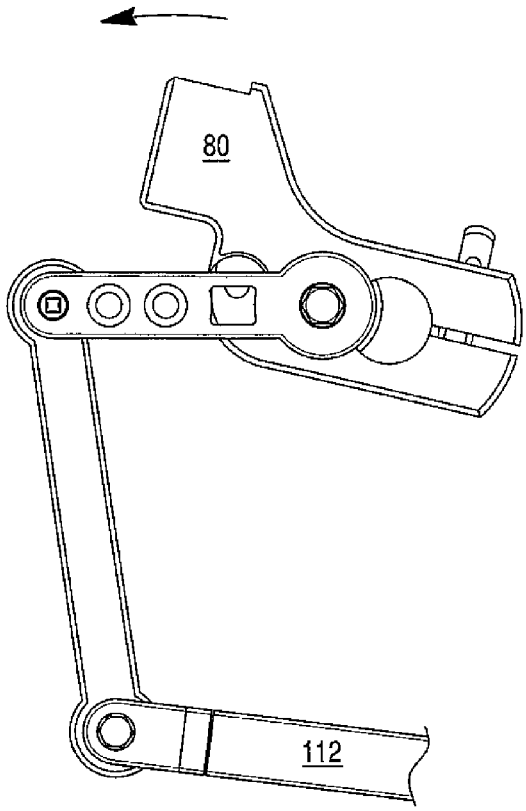

FIGS. 10 and 11 show the beater holder 80 mounted in the "heavy" position on the shaft 107 such that the beater (not shown) is positioned linearly or radially closer to the drum surface that is struck by the beater. In the view shown in FIG. 10, the pedal assembly is shown with the beater angled away from the drum surface like the schematic shown in FIG. 5*b*. As the pedal is depressed, the axle shaft rotates and the beater approaches the drum surface as shown in FIG. 11.

In addition to the two linearly or radially adjustable mounting position provided by the beater holder 80 (i.e., light versus heavy feet), the beater holder itself may be adjusted circumferentially (around the periphery of the axle shaft 107) to adjust the angle of the beater relative to the drum surface and the axle shaft. Therefore, with the clam-shell design of the beater holder 80, the beater holder 80 may be adjusted around the axle shaft 107 before the fastener 90 is tightened to secured the beater holder 107 to the axle shaft 107. Thus, the invention provides a connecting system that connects the pedal to the shaft such that movement of the pedal between the operating and return positions rotates the shaft and rotates the beater head toward and away from the drum head for beating the drum head. The beater holder can be angled infinitely around the axle shaft 107 and can be linearly adjusted relative to the pedal's axle to provide a "LIGHT" or "HEAVY" feel; thereby providing a dual adjustment structure.

From the foregoing description, it is clear that the present invention provides a beater holder for a bass drum pedal that (1) can be angled infinitely (i.e., circumferentially) around the shaft 107 and (2) can be mounted to the pedal's axle to provide a "LIGHT" or "HEAVY" feel. Such a dual adjustment structure for the beater is not known in the art. Further, the invention has a clam-shell design for easy change-over to the "LIGHT" and "HEAVY" positions without dismantling the pedal.

Although the invention has been described with reference to the preferred embodiments illustrated in the drawings, it is noted that equivalents may be employed and substitutions made herein without departing from the scope of the invention as recited in the claims. In particular, as mentioned, the specific pedal assembly may be altered without departing from the spirit and scope of the invention. Also, the exact configuration of the beater holder may be modified without departing from the spirit and scope of the invention whereby the beater holder may be linearly adjusted relative to the axle shaft.

The invention claimed is:

1. An apparatus for enabling adjustment of the amplitude of swing of a drum beater with respect to a drum head, the apparatus comprising:

a support;

an axle shaft supported by the support and rotatable around an axis of the shaft;

a pedal pivotable between an operating position to which the pedal is operated by the operator and a return position;

a beater holder non-rotatably fastened to the axle shaft;

a drum beater comprising a beater head and a beater rod fastened to the beater holder; and connecting means connecting the pedal to the axle shaft such that movement of the pedal between the operating and return positions rotates the axle shaft and through the beater holder, rotates the beater head toward and away from the drum head for beating the drum head;

the beater holder is configured for radial adjustment with respect to the axle shaft;

the beater holder being in the form of a clamp clampable on the axle shaft at least two discrete radial positions of the beater holder relative the axle shaft and unclampable for enabling resetting the radial positions of the beater holder.

2. The apparatus according to claim 1, wherein the radial adjustment is linear.

3. The apparatus according to claim 1, wherein the beater holder further is adjustable angularly with respect to the shaft independent of the radial adjustment.

4. The apparatus according to claim 1, wherein the clamp is clampable on the axle shaft to secure the clamp and the beater head at a selected circumferential orientation around the shaft and which is unclampable for enabling resetting the selected circumferential orientation of the beater holder so as to adjust an angle of the drum beater relative to a drum surface of the drum head and the axle shaft.

5. The apparatus according to claim 1, wherein the beater holder comprises:

a main body having a clamping face;

a beater connector for mounting a drum beater rod directly to the main body so that the beater rod may be positioned to strike the drum head; and a hinge arm connected to the main body through a hinge and having a clamping face facing the clamping face of the main body;

wherein the main body and the hinge arm define the clamp such that the clamping faces of the main body and the hinge arm engage the axle shaft.

6. The apparatus according to claim 5, wherein each of the clamping faces of the main body and the hinge arm is formed with corresponding first and second concave surfaces such that the first and second concave surfaces of the main body and the hinge arm define at least two mounting holes located on the different distance from the beater rod for mounting the beater holder to the axle shaft the at the least two discrete radial positions with respect to the axle shaft.

7. The apparatus according to claim 5, further comprising a fastener passing through the main body and threaded into the hinge arm to selectively secure the beater holder to the axle shaft.

8. The apparatus according to claim 5, wherein the hinge comprises a pin passing through both the main body and the hinge arm to provide a pivoting connection between the main body and the hinge arm.

9. A beater holder for a drum pedal assembly, comprising:

a main body having a clamping face;

a beater connector for mounting a drum beater rod to said main body so that said beater rod may be positioned to strike a drum head; and a hinge arm connected to said main body through a hinge and having a claming face facing said camping face of said main body;

wherein said main body and said hinge arm define a clamp clampable on an axle shaft such that the clamping faces of the main body and the hinge arm engage the axle shaft to secure said clamp and said beater head at at least two discrete radial positions of the beater holder relative said axle shaft and unclampable for enabling resetting the radial positions of said beater holder.

10. The apparatus according to claim 9, further comprising a fastener passing through said main body and threaded into said hinge arm to selectively secure said beater holder to said axle shaft.

11. The apparatus according to claim 9, wherein said hinge comprises a pin passing through both said main body and said hinge arm to provide a pivoting connection between said main body and said hinge arm.

12. The apparatus according to claim 9, wherein each of said clamping faces of said main body and said hinge arm is formed with first and second concave surfaces such that said first and second concave surfaces of said main body and said hinge arm to define at least two mounting holes for mounting said beater holder to said axle shaft the at the least two discrete radial positions with respect to said axle shaft.

13. The apparatus according to claim 9, wherein the clamp is clampable on the shaft to secure the clamp and the beater head at a selected circumferential orientation around the shaft and which is unclampable for enabling resetting the selected circumferential orientation of the beater holder so as to adjust an angle of the drum beater relative to a drum surface of the drum head and the axle shaft.

14. An apparatus for enabling adjustment of the amplitude of swing of a drum beater with respect to a drum head, the apparatus comprising:

a support;

an axle shaft supported by the support and rotatable around an axis of the shaft;

a pedal pivotable between an operating position to which the pedal is operated by the operator and a return position;

a beater holder non-rotatably secured to the axle shaft;

a drum beater comprising a beater head and a beater rod fastened to the beater holder; and connecting means connecting the pedal to the axle shaft such that movement of the pedal between the operating and return positions rotates the axle shaft and through the beater holder rotates the beater head toward and away from the drum head for beating the drum head;

the beater holder being securable to the axle shaft at least two discrete radial positions relative the axle shaft so as to provide a radial adjustment of the beater holder with respect to the axle shaft.

15. The apparatus according to claim 14, wherein the radial adjustment is linear.

16. The apparatus according to claim 14, wherein the beater holder further is adjustable angularly with respect to the shaft independent of the radial adjustment.

17. The apparatus according to claim 16, wherein the beater holder is securable to the axle shaft at a selected circumferential orientation around the shaft so as to adjust an angle of the drum beater relative to a drum surface of the drum head and the axle shaft.

* * * * *